United States Patent [19]

Bartlett

[11] 4,214,294

[45] Jul. 22, 1980

[54] ADJUSTABLE LAMP FOR FURNITURE ATTACHMENT

[76] Inventor: Charles C. Bartlett, P.O. Box 489, Waterloo, N.Y. 13165

[21] Appl. No.: 947,210

[22] Filed: Sep. 29, 1978

[51] Int. Cl.[2] ..... F21V 33/00; F21V 21/14; F21V 21/22

[52] U.S. Cl. ..... 362/127; 362/131; 362/396; 362/413; 362/414; 362/419; 362/424; 362/428; 362/432

[58] Field of Search ..... 362/127, 131, 133, 134, 362/151, 152, 396, 413, 414, 419, 424, 428, 431, 432

[56] References Cited

U.S. PATENT DOCUMENTS

| | | | |
|---|---|---|---|
| 2,299,683 | 10/1942 | Curtis | 362/413 |
| 3,729,627 | 4/1973 | Littell | 362/131 |
| 3,851,166 | 11/1974 | Kohler et al. | 362/396 |

FOREIGN PATENT DOCUMENTS

| | | | |
|---|---|---|---|
| 676056 | 5/1939 | Fed. Rep. of Germany | 362/127 |
| 2535607 | 10/1977 | Fed. Rep. of Germany | 362/127 |
| 531001 | 1/1922 | France | 362/413 |
| 924081 | 3/1947 | France | 362/413 |
| 225 | of 1911 | United Kingdom | 362/413 |

OTHER PUBLICATIONS

Advertisement, Adjustable Fixture Co., Milwaukee, Wisc.

*Primary Examiner*—Howard A. Birmiel

[57] ABSTRACT

An adjustable reading lamp that is attachable to the back of a chair or the like for supporting the lamp in a generally vertical position regardless of the angular inclination of the mounting surface while at the same time affording an extremely wide range of adjustments whereby illumination from the lamp may be conveniently and easily directed into any desired viewing region.

8 Claims, 3 Drawing Figures

ADJUSTABLE LAMP FOR FURNITURE ATTACHMENT

BACKGROUND OF THE INVENTION

This invention relates to an adjustable reading lamp and, in particular, to an adjustable reading lamp that is suitable for attachment to a piece of furniture such as a chair or the like.

As disclosed in U.S. Pat. No. 2,833,502, adjustable reading lamps that are capable of being attached to the back of a chair or any other suitable piece of furniture have been known and used for some time. Typically, these prior art lamps are relatively large and bulky devices which are clamped or screwed to the back of a chair without regard to the inclination of the mounting surface. As a consequence, the overall posture or alignment of the lamp oftentimes is offset at an odd angle thereby presenting a rather unsightly assemblage which distracts from the overall appearance of the surroundings in which the lamp is placed.

Moreover, and possibly more importantly, many prior art lamps of this type, although being complex in construction, fail to deliver a full range of adjustments that are needed to permit the user to direct illumination into a desired viewing plane or region. A full range of adjustments is particularly important when the lamp is mounted upon the back of a chair and is used in an attempt to direct light in an unimpeded manner into the reading or working plane of a person seated in the chair. As can be seen, an improperly positioned lamp, under these conditions, can produce shadowing or other lighting defects in the viewing region whereby the lamp is rendered unsuitable to carry out the intended lighting task.

SUMMARY OF THE INVENTION

It is therefore an object of the present invention to improve lamps used for reading or working.

A further object of the present invention is to provide a fully adjustable lamp that is capable of being affixed to a piece of furniture such as a chair or the like.

A still further object of the present invention is to enable a reading or working lamp that is affixed to a piece of furniture or the like to be supported in a substantially vertical position regardless of the angular inclination of the lamp supporting surface.

Another object of the present invention is to provide a chair mounted reading lamp that can be conveniently and easily adjusted by the user to direct light into a desired viewing region.

These and other objects of the present invention are attained by means of a lamp which includes a source of illumination mounted within a shade that is pivotably affixed to a support standard, an elongated housing containing a series of friction bushing encompassing the standard so that the standard may be both rotated and axially repositioned therein, a base that is capable of being secured as by screws or the like to a mounting surface and an adjusting bracket acting between the base and the standard housing whereby the angular relationship between the base and the housing may be adjusted to a desired position so as to maintain the lamp in a vertical plane regardless of the degree of inclination of the support surface.

BRIEF DESCRIPTION OF THE DRAWINGS

For these and other objects of the present invention reference is had to the following detailed description of the invention to be read in conjunction with the following drawings wherein.

DESCRIPTION OF THE INVENTION

Figure 1:
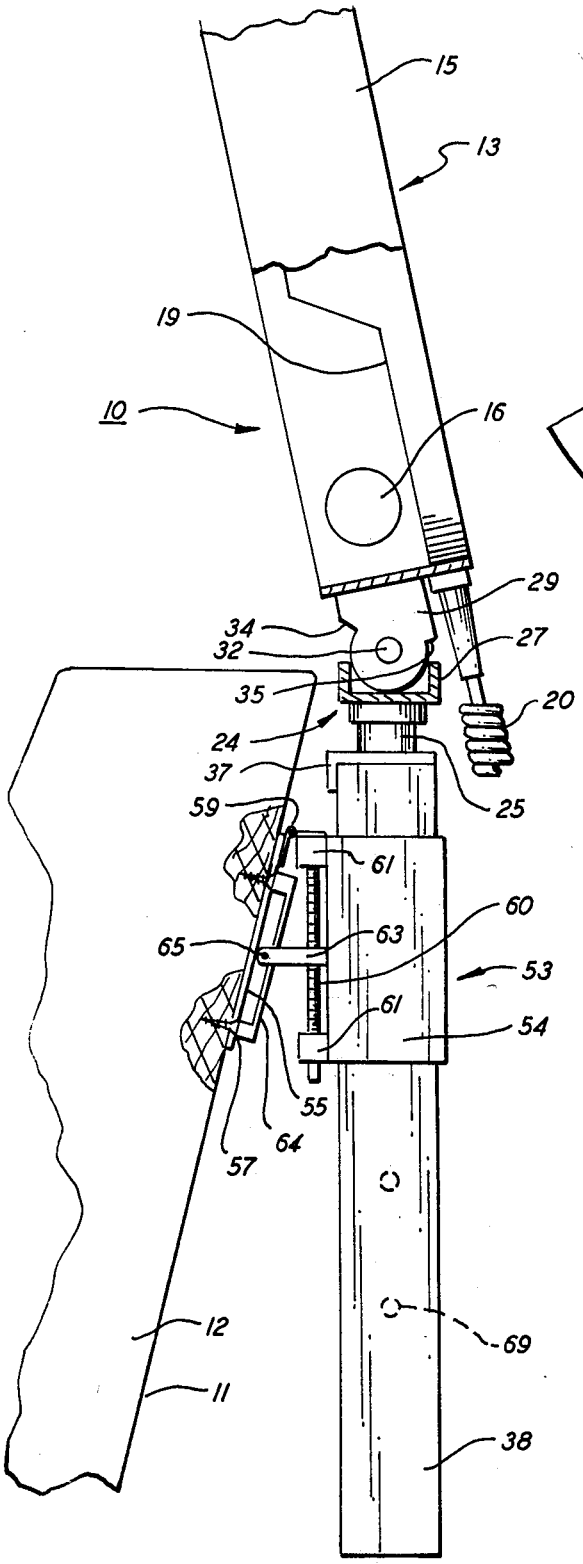
FIG. 1 is a side elevation of a lamp embodying the teachings of the present invention showing the lamp mounted upon the inclined back surface of a chair.

With reference to the drawing, and initially with particular reference to FIG. 1, a lamp, generally referenced 10, is shown mounted upon the inclined back surface 11 of a chair 12. Although the present lamp is shown used in conjunction with a chair, it should be made clear at this point that the lamp may be similarly mounted upon any suitable support structure for holding the lamp in a position wherein the illumination emitted therefrom can be directed into a desired viewing region such as a reading plane or working plane of the person using the lamp. The upper or illuminant section 13 of the lamp includes a circular shade 15 containing a circular fluorescent lighting tube 16 of standard commercial configuration. Here again, the invention is not limited to the specific structure of the illuminating device and any suitable source of illumination may be similarly employed without departing from the teachings of the present invention.

The fluorescent tube 16 is connected to an electrical receiving socket 17 secured inside the shade 15 which provides power to the tube and also serves to align the tube within the shade. A contoured reflecting sheet 19 is also contained within the shade and is mounted behind the light source to redirect or reflect the light through the open face of the shade in the viewing region. An electrical cord 20 is brought into the lower part of the shade and the cord is brought upwardly behind the sheld to a control switch 22 (FIG. 3) used for turning the light on and off. In this embodiment of the invention, the switch is centrally located within the shade where it can be conventiently actuated by a person seated in the chair.

A shade tilting assembly 24 connects the bottom of the shade with a tubular support standard 25. The tilting assembly includes an enclosure 27, which in practice, is a channel shaped member, and a collar 28 for affixing the enclosure to the standard. A tilting block 29, which is secured to the lamp shade, is operatively connected with two end blocks 30-30 by means of a pair of split compression rings 31-31. The rings, acting between the tilting block and the end blocks, provide sufficient friction to the system so that the shade may be angularly tilted to any desired position about an axle 32 that is horizontally supported in the assembly between the end blocks.

Tilting block 29 is equipped with a forward stop 34 and a rear stop 35 that cooperate to restrict the angular movement of the shade between preselected limits. In operation the stops are arranged to move into arresting contact against the side walls of the channel shaped enclosure 27 to prevent further movement of the shade in either direction.

The vertically extended body of the standard 25 passes downwardly through cover 37 into a rectangular casing or housing 38. A holding device, generally referenced 40 (FIG. 3) is mounted within the housing and functions to permit the standard to be raised and lowered within the housing as well as being rotated about its elongated central axis. The holding device 40 contains two holding blocks 43 that are affixed to the upper inner wall of the housing by means of rivets 41 and in which are contained one or more resilient clamps 45. In operation, the clamps frictionally engage the outer surface of the tubular standard with sufficient pressure to support the standard, and thus the shade assembly, at any desired elevation while at the same time permitting the standard to be turned about its central axis.

A stop mechanism in the form of a radially extended pin 47 is secured in the bottom side wall of the standard. The axial length of the pin is such that it can be rotated into arresting contact against opposed inner side walls of the housing and thus limit the amount of rotation provided to the lamp. In practice, the standard is allowed to move about 50 degrees to either side of the central position shown in FIG. 3. A bracket 50, having an oblique flange 51 depending inwardly therefrom, is secured to the lower inner wall of the housing by means of screws 52. When the standard is moved toward a fully lowered position within the housing, the pin 47 drops into a slot formed within the center of the flange 51 to prevent the lamp from being rotated when in this position.

In assembly, the housing 38 is slidably received within an adjustable mounting fixture 53. The fixture includes a frame 54, which compliments and encompasses the outside of the housing to provide a close running fit therebetween, and a mounting base plate 55 that is secured to the frame of the chair via a plurality of wood screws 57 or any other suitable means. The upper surfaces of both the frame and the base plate are cojoined by a hinge 59.

Figure 2:
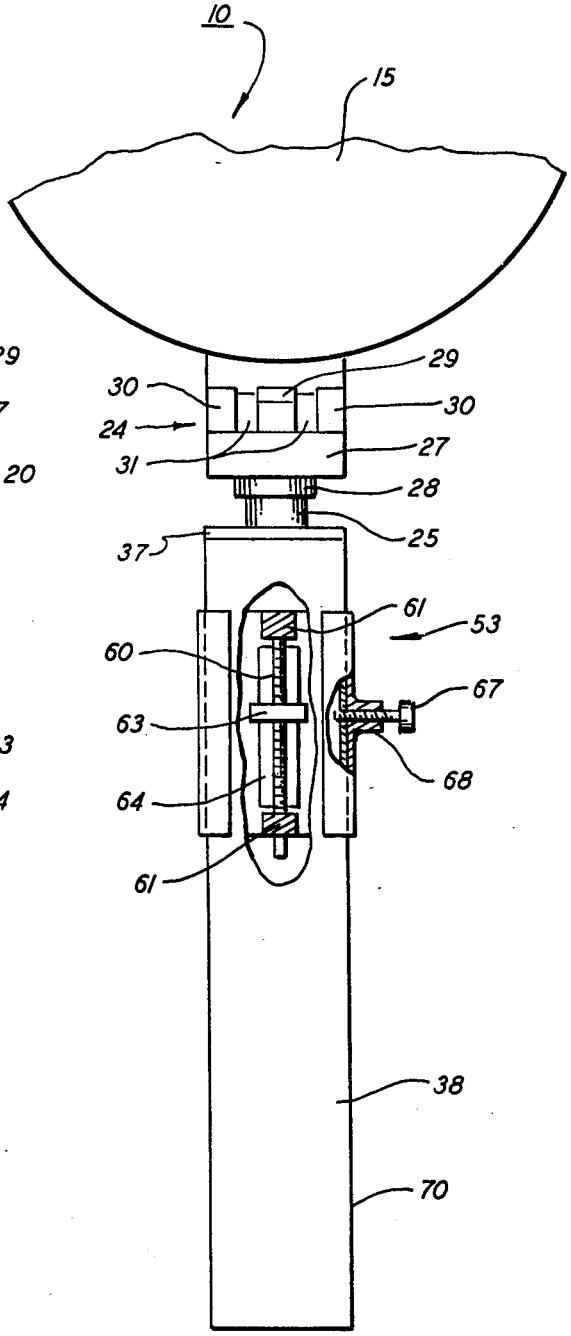
FIG. 2 is a rear view of the lamp illustrated in FIG. 1 with a portion broken away to better illustrate the adjusting bracket employed therein.
Figure 3:
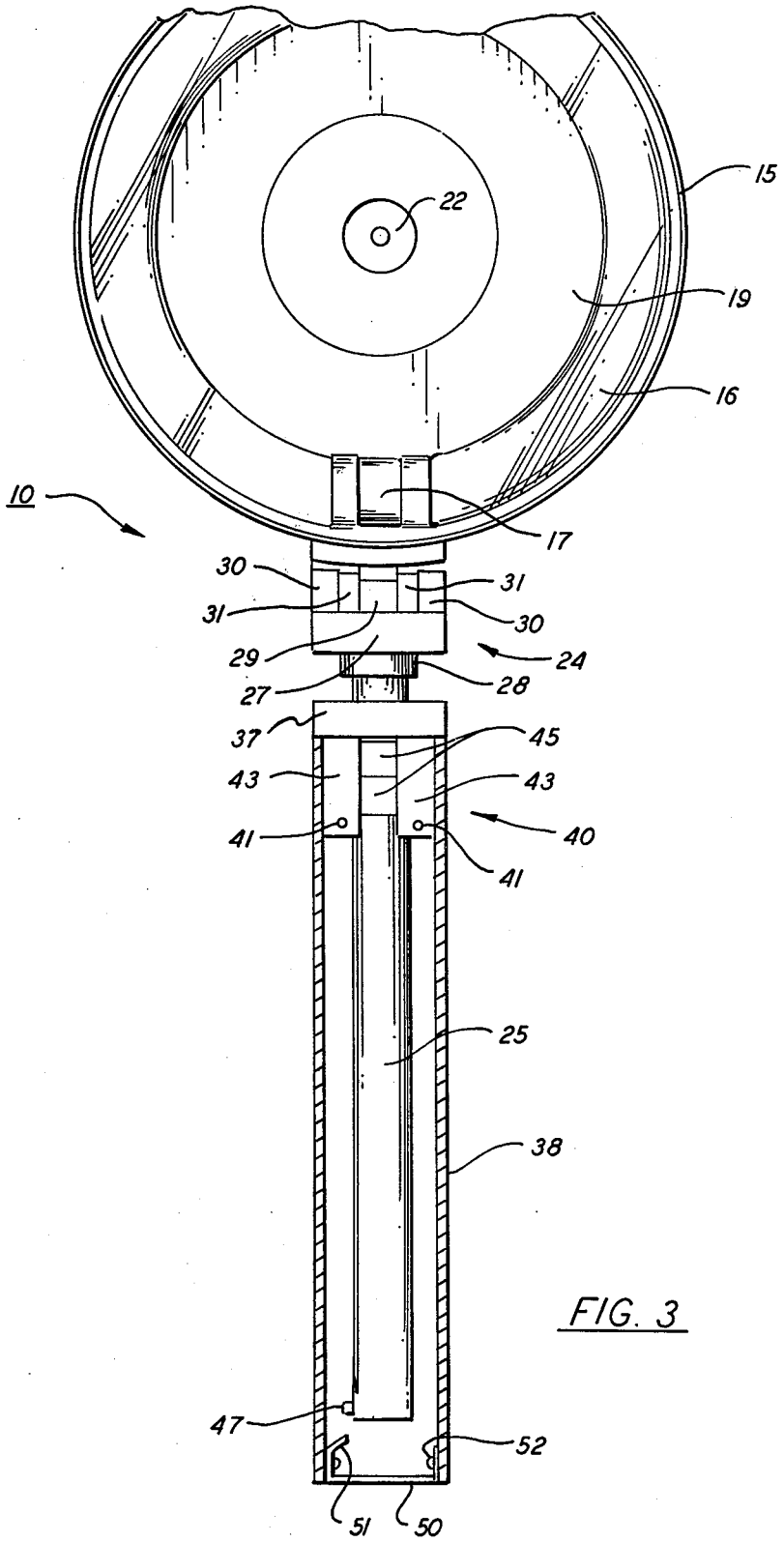
FIG. 3 is a front view of the lamp illustrated in FIG. 1 showing the adjusting bracket removed and having portions broken away to show the interior of the housing.

As best seen in FIGS. 2 and 3 a lead screw 60 is rotatably supported in bearing blocks 61-61 secured to the rear face of the frame 54 adjacent to the base plate 55. A horizontally extended adjusting bar 63 is threadably engaged by the lead screw with the distal end thereof being bifurcated so that the two arms thereof can pass freely over a slide 64 carried upon the front face of the base plate. A pin 65 is secured in both arms of the adjusting bar with the body of the pin extending beneath the slide.

In operation, the mounting bracket is employed to adjust the vertical positioning of the lamp to enable the lamp to be placed in an upright posture regardless of the angular inclination of the supporting structure. This is achieved by turning the lead screw within the bearing blocks whereupon the adjusting bar is caused to move up or down within the stationary slide. Accordingly, the angular relationship between the fixed base plate and the pivotably mounted lamp is altered. By simply manipulating the lead screw the lamp can be brought to an upright or vertical position without disturbing the mounting surface.

A means for initially adjusting the elevation of the lamp that may be used at the time of mounting is also herein provided. This means includes a thumb screw 67 that is threaded into a raised boss 68 depending outwardly from one of the walls of frame 54 as shown in FIG. 2. The shank of the thumb screw is arranged to coact with a series of spaced apart holes 69 formed in the adjacent side wall 70 of the housing 38. In assembly, the holes are capable of being brought into alignment with the shank of the thumb screw as the housing is raised or lowered within the frame. When the housing is placed at a desired vertical position, the thumb screw is turned into the adjacent hole thereby securing the housing within the frame. This provides a rough adjustment for the lamp whereby the lamp may be more finely adjusted simply by raising or lowering the standard within the housing.

As should be evident from the above noted disclosure, the lamp of the present invention allows the light source to be adjusted in any number of directions to direct light into a desired region. While this invention has been described with specific reference to the disclosure above, it is not necessarily confined to the detail as set forth but is intended to cover any modifications within the scope of the following claims.

I claim:

1. A lamp for attachment to a piece of furniture including an electrical source of illumination mounted within a shade, a support standard mounted by a pivot to said shade whereby the angular position of the shade in reference to the axis of the standard is adjustable, an elongated housing enclosing said standard having at least one friction bushing secured therein for engaging the standard in friction supporting contact whereby the standard can be moved axially within the housing and also rotated about its axis within said bushing, a mounting fixture having a base securable to a piece of furniture and a frame rotatably mounted on the base by means of a horizontal hinge, said frame arranged to slidably receive said housing therein, and a locking means for securing the housing within the frame at a predetermined position, and an adjustable bracket acting between the base and the frame being operable to change the angular relationship therebetween whereby the frame may be moved to a vertical position when the base is affixed to an inclined surface.

2. The lamp of claim 1 further including friction rings mounted on said pivot and being arranged to act between the shade and the standard to movably secure the two elements in a selected angular position.

3. The lamp of claim 1 wherein said locking means consists of a thumbscrew threaded into one side wall of the frame and being receivable within one of a plurality of vertically aligned holes formed in the adjacent side wall of the housing mounted within the frame.

4. The lamp of claim 1 wherein said adjusting bracket includes a guide secured to the base, a slide movably positioned upon the guide, and a lead screw rotatably mounted upon the frame which is threaded through the slide and being arranged to move the slide toward and away from the hinge.

5. The lamp of claim 1 further including a radially extended arm secured in the bottom of said standard and being arranged to engage the inner walls of the housing to limit the freedom of rotation of said standard.

6. The lamp of claim 5 further including a stop means located in the bottom of said housing also being arranged to engage the arm and limit the freedom of axial movement of the standard as it is moved into said housing.

7. The lamp of claim 1 wherein the source of illumination is an electric light having a reflecting sheet mounted therebehind.

8. The lamp of claim 1 wherein said standard mounted within said housing is engaged by two friction bushings adapted to position said standard in vertical alignment within the housing.

* * * * *